United States Patent [19]

Pennington

[11] 3,982,633

[45] Sept. 28, 1976

[54] DISPLAY DEVICE

[76] Inventor: John James Pennington, Dalefords Cottage, Dalefords Lane, Whitegate, near Northwich, Cheshire, England

[22] Filed: Jan. 2, 1975

[21] Appl. No.: 537,855

[30] Foreign Application Priority Data

Jan. 4, 1974 United Kingdom ..... 406/74

[52] U.S. Cl. ..... 211/4; 206/44.12; 206/45.31; 206/387; 211/40; 211/169; 220/20; 220/338

[51] Int. Cl.[2] ..... B65D 85/62; E05B 73/00

[58] Field of Search ..... 220/20, 338, 340; 206/.82, .83, .84, 45.31, 387, 44.12; 211/4, 40, 169

[56] References Cited

UNITED STATES PATENTS

| | | | |
|---|---|---|---|
| 1,391,063 | 9/1921 | Kaskell | 206/.83 |
| 1,421,391 | 7/1922 | Bower | 211/169 |
| 1,751,615 | 3/1930 | Bower | 206/.83 |
| 2,544,118 | 3/1951 | Went | 206/.83 |
| 3,337,059 | 8/1967 | LeHoy | 211/169 |
| 3,478,893 | 11/1969 | Crosslen | 211/169 |
| 3,495,716 | 2/1970 | Gregory | 211/4 |
| 3,760,952 | 9/1973 | White | 211/4 |
| 3,797,649 | 3/1974 | Ringle | 206/.82 |

*Primary Examiner*—William Price
*Assistant Examiner*—Bruce H. Bernstein
*Attorney, Agent, or Firm*—Pearson & Pearson

[57] ABSTRACT

A display device, particularly for small valuable articles such as pre-recorded tape cassettes, comprising two open ended transparent and/or apertured container parts which are movable relative to each other. The open ends of the container parts can be brought together to prevent removal of articles from the parts through the open ends, and the ends can be moved apart to permit insertion of articles into the parts. A lock is provided for locking the container parts together when their open ends have been brought together.

3 Claims, 7 Drawing Figures

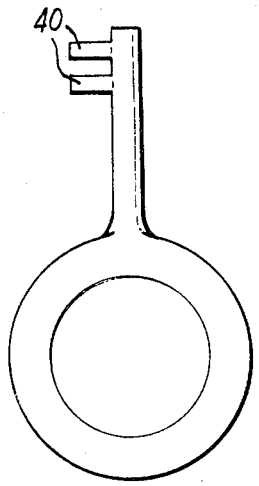
FIG. 7
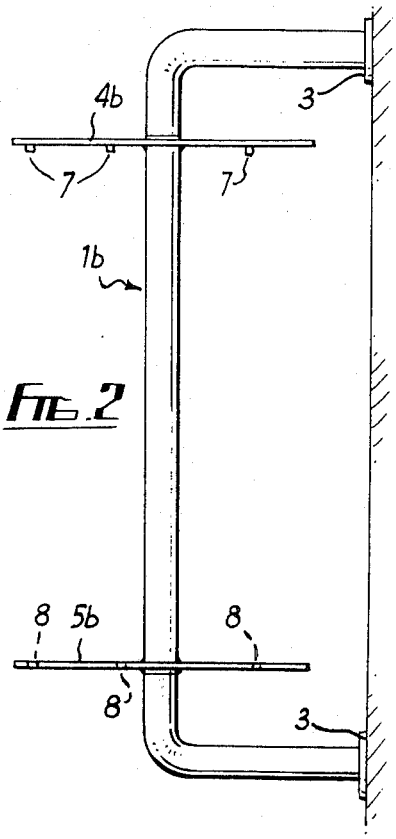
FIG. 2
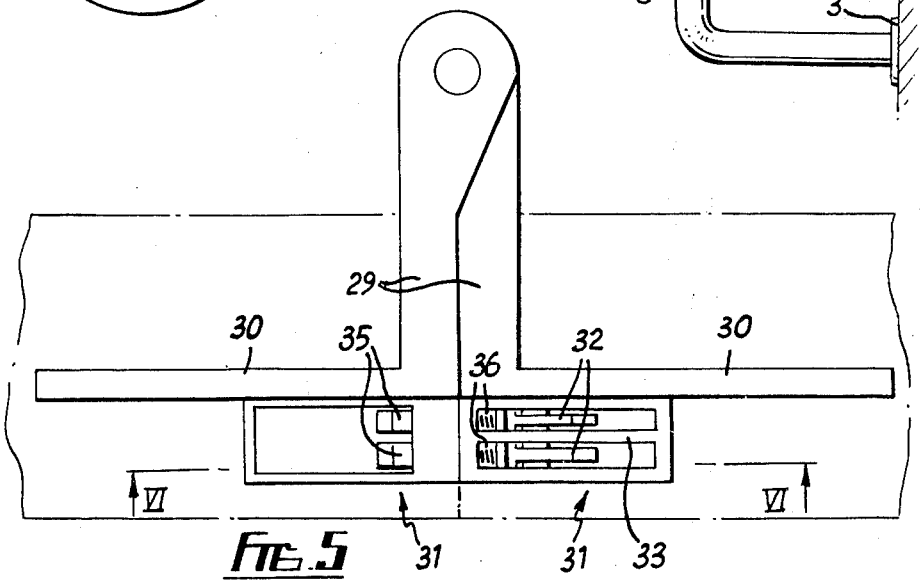
FIG. 5
FIG. 6
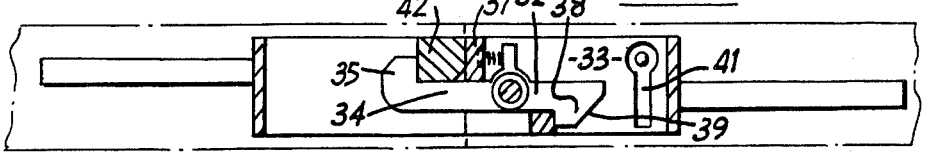

DISPLAY DEVICE

This invention relates to a display device particularly although not exclusively for displaying pre-recorded tape cassettes.

Pre-recorded tape cassettes raise problems with regard to display of same for sale in a shop.

On the one hand, the display arrangement should be such that prospective purchasers can easily inspect all of the information carrying surface areas of cassettes, and such that cassettes can be easily removed from and inserted in the display arrangement by an authorised person, whilst on the other hand cassettes should be securely retained against unauthorised removal. In this latter respect, cassettes are particularly likely to be stolen due to their relatively small size and high value.

An object of the present invention is to provide a display device with which the requirements mentioned in the preceding paragraph can all be met in a simple and inexpensive manner.

According to the present invention therefore there is provided a display device, for displaying a plurality of articles, comprising a container formed in two parts each adapted to receive and retain at least one article to be displayed and being apertured and/or of a transparent nature so as to permit inspection of such article therein, each part having an opening at one side through which said article can be inserted into or removed from the part and the two parts being movable relative to each other between open and closed positions at which respectively the openings are freely accessible for insertion and removal of articles as aforesaid and the said openings are in confronting relationship so as to prevent free access thereto for the purpose of removal or insertion of articles as aforesaid, and locking means for locking said parts in said closed position.

With this arrangement, cassettes can be displayed in an easily inspectable yet secure manner, and when it is desired to remove or insert a cassette this can be effected easily and quickly by an authorised person by unlocking said locking means and moving the container parts relative to each other to the open position thereof.

Preferably, the container parts are hinged together so as to be pivotally movable relative to each other, although the invention is not restricted to this feature and for example the container parts may be slidable towards and away from each other.

Preferably, the locking means is formed in first and second locking parts secured respectively on the two container parts, one of said locking parts having projecting spring loaded catch levers and the other of said locking parts having an opening for receiving and projecting levers and a stop for locking engagement therewith, a keyhole being provided in the said one locking part through which a key can be inserted for releasing the levers from the stop. The said one locking part may incorporate a partition between the or each pair of adjacent levers. The locking means may be formed in first and second locking parts fixed respectively on the container parts, the locking parts being secured respectively to hingedly interconnected arms.

The invention will now be described further by way of example only and with reference to the accompanying drawings in which:

FIG. 2 is a side elevation of a modification of the arrangement of FIG. 1 for mounting on a wall surface;

FIG. 5 is a top view of a hinge and lock device of the arrangement of FIGS. 1 and 2;

FIG. 6 is a sectional view on the line VI—VI of FIG. 5; and

FIG. 7 shows a key for use with the lock of FIGS. 5 and 6.

Figure 1:
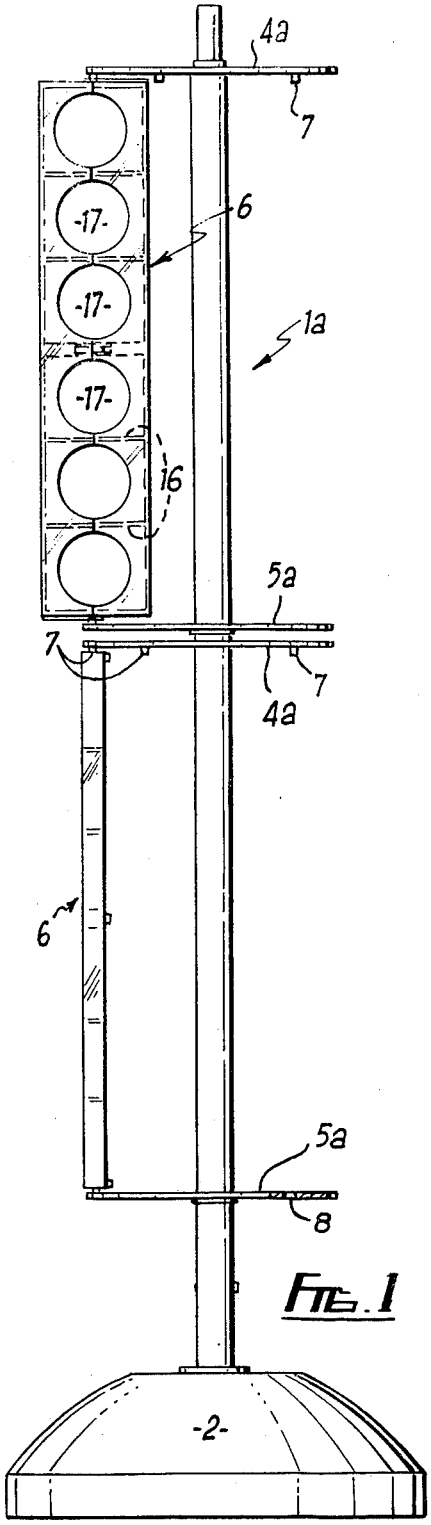
FIG. 1 is a diagrammatic side elevation of one form of a display stand according to the present invention.

The display arrangements of FIGS. 1 and 2 are for use in displaying pre-recorded tape cassettes in rectangular boxes. Each arrangement comprises a central elongated support member such as a tube 1*a*, 1*b*. The arrangement of FIG. 1 has a straight tube 1*a* which is secured at one end to a base 2 which in use stands on a floor or ground surface with the tube 1*a* projecting vertically upwards therefrom. The tube 1*b* of the arrangement of FIG. 2 has a straight central portion and two perpendicular end portions which terminate in wall-mounting brackets 3. Two pairs of discs 4*a*, 5*a* are mounted at vertically spaced positions on the central tube 1*a* of the arrangement of FIG. 1, and one pair of vertically spaced discs 4*b*, 5*b* are mounted on the central portion of the tube 1*b* of the arrangement of FIG. 2. All discs are freely rotatable about the respective tube axes.

Between each pair of discs 4*a*, 5*a*, 4*b*, 5*b*, there are mounted a plurality of vertically extending elongated multi-compartment containers 6 at positions equally spaced circumferentially around the peripheries of the discs and equally spaced from the respective tube axes. For the sake of clarity only one such container 6 is shown between each pair of discs 4*a*, 5*a* in FIG. 1 and no containers are shown in FIG. 2. The containers 6 are pivotally mounted on spigots 7 depending from the underside of the top disc 4*a*, 4*b* of each pair of discs and in holes 8 aligned with the spigots 7 in the corresponding lower disc 5*a*, 5*b* whereby the containers 6 are rotatable about vertical axes parallel to the respective tube axes.

Figure 3:
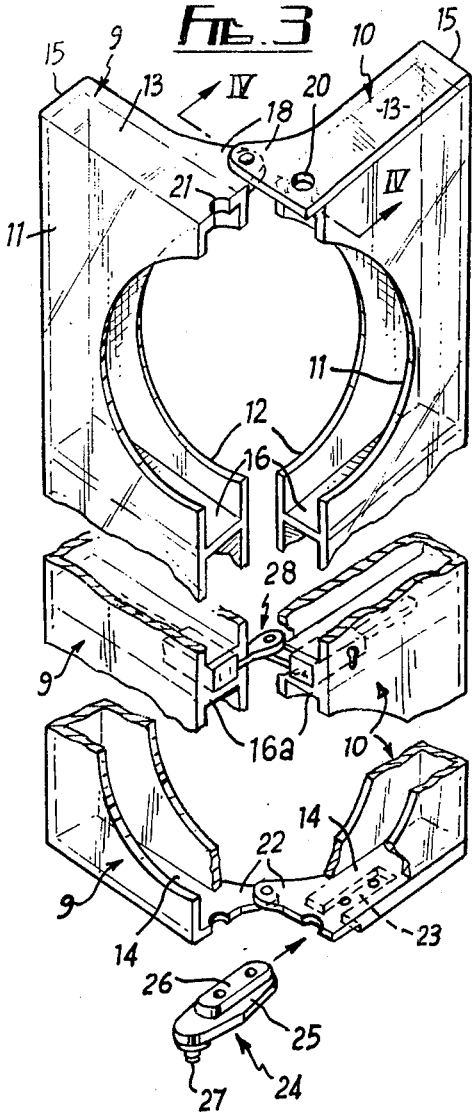
FIG. 3 is a perspective view of one multi-component container of the arrangements of FIGS. 1 and 2 in an open condition.

Each container 6 is divided longitudinally as is clearly shown in FIG. 3, into two halves 9,10, each half being formed as a one piece moulding from a transparent plastics material. Each half is a box-construction having front and back side walls 11,12, top and bottom walls 13,14 and an outer edge wall 15, the inner edge, that is, the edge nearer to the other half, being open. Each half is also divided vertically into a number of separate compartments by means of dividing walls 16, and aligned semi-circular openings are provided in the front and back side walls 11,12 for each compartment. The two halves 9,10 are hingedly interconnected so as to be pivotable about a vertical axis parallel to the respective tube axis between an open position as shown in FIG. 3 at which pre-recorded tape cassettes can be inserted into or removed from the compartments in the container halves via the open edges thereof, and a position at which the peripheries of the open edges are brought into abutment with each other thereby preventing access to the compartments via same. In the latter position the dividing walls 16 of one half are in alignment with the dividing walls of the other half and the respective semi-circular openings combine to form circular openings 17 (FIG. 1). In the open position, the semi-circular openings facilitate gripping of cassettes in the compartments and in the closed position the circular openings facilitate viewing of the cassettes although this is also rendered possible by the transparency of the plastics material. The cassettes are of only slightly smaller dimensions than the compartments so that they cannot be removed therefrom except through the open edges.

Figure 4:
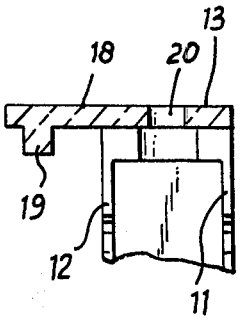
FIG. 4 is a sectional view on the line IV—IV of FIG. 3.

The pivotal interconnection of the container halves 9,10 is effected at three positions, namely at the top, bottom and center thereof. At the top, each top wall 13 is thickened relative to the side walls 11,12 in the region of the side walls and has a rearwardly projecting extension 18. As can be seen from FIG. 4, the extension of the right half 10 (as seen in FIG. 3) has a downwardly projecting pivot pin 19, and a corresponding hole is provided in the left extension 18 to receive the pin 19. The right half top wall 13 projects slightly beyond the respective open edge and in the closed position of the container this projecting part overlies the left half top wall 13. The right half top wall 13 has therein a hole 20 centered mid-way between the side walls 11,12 and level with the open edge and a corresponding semi-circular cut-out 21 is provided in the adjacent edge of the left half top wall 13, whereby a pivot hole is formed to receive the respective spigot 7 on the top disc 4*a* or 4*b*.

At the bottom, the bottom walls 14 are thickened and have rearwardly projecting extensions 22 provided with a cooperating pin and hole arrangement, similar to the extensions 18 of the top walls 13. The right half bottom wall 14 also has a channel 23 therein and a mounting piece 24 is provided for attachment to the wall 14. The mounting piece 24 comprises a flange 25 with a projecting ridge 26 on one side which fits in the channel 23 and a pin 27 on the other side. The piece is secured in place by bolts or the like passed through holes in the ridge 26 and in the floor of the channel 23 and when in place the pin 27 is aligned with the hole 20 in the top wall 13. The pin 27 forms a pivot pin which engages the respective hole 8 in the lower disc 5*a* or 5*b*.

At the center, the central dividing walls 16*a* are formed thicker than the other dividing walls 16 and a hinge and lock mechanism 28 is embedded therein. This mechanism is formed in left and right halves. Each half of the mechanism comprises a rearwardly projecting hinge arm 29, an elongated rigid element 30 secured to the inner end of the arm 29 and extending perpendicularly thereto, and a box structure 31 fixed at the inner end of the arm 29. The free ends of the arms 29 overlap and are pivotally interconnected by means of a pin passed through aligned holes therein or by means of a pin secured to one arm and engaging a hole in the other arm. The box structures 31 have adjacent peripheries which abut in the closed position of the container. In the right box structure 31 two levers 32 are mounted side-by-side with a partition wall 33 therebetween. The levers 32 are pivotally mounted between their ends and project at one end 34 out of the box structure from the end of the box structure adjacent the other box structure, said end being open. The projecting ends 34 have upwardly extending projections 35 thereon and the ends 34 are urged upwardly by means of springs 36 inside the right box structure. A stop 37 at the open end of the right box structure limits movement of the ends 34 upwards. The opposite, inner ends

38 of the levers 32 have inclined surfaces 39 for engagement with prongs 40 of a key of the kind shown in FIG. 7. The key can be inserted into the right box structure through a key-hole at the front thereof and through a keyhole 41 in the partition 33 so that the prongs 40 are arranged one on each side of the partition 33. Clockwise movement of the key then causes the prongs 40 to engage the surfaces 39 whereby the projecting lever ends 34 are pivoted downwardly against the action of the springs 36. The left box structure is open at that end thereof adjacent the right box structure and the projecting lever ends 34 can enter through said end. A stop 42 is provided at the upper part of the open end and it will be seen that movement of the box structures into abutment with each other causes the projecting lever ends 34 to be deflected downwards by the stop 42 against the action of the springs 37 to enable the lever ends 34 to enter the left box structure. When the lever ends 34 have entered the left box structure they are moved upwards by the springs 37 to catch behind the stop 42 and thereby lock the box structure together. Opening can then be effected by downwards movement of the lever ends 34 with the key as aforesaid.

With the arrangement described above, cassettes can be inserted into and removed from the compartments in the container halves simply and quickly by an authorised person. Such person need only unlock the halves with the key as aforesaid and then pivot the left half away from the right half about a vertical axis which extends externally of the container through the top, bottom and central hinges thereby opening the edges of the container halves. To close the halves these are simply pushed together.

With the containers closed and containing cassettes these are clearly visible through the circular openings and transparent plastics material of the container, and the containers can be rotated individually about vertical axes extending through the containers through the pins and holes 7,8 and bodily with the discs 4,5 about the respective tube axis. With the containers closed, however, the cassettes are securely retained therein and cannot easily be removed by an unauthorised person. In this respect the lock mechanism 28 is particularly advantageous in that the partition 33 ensures that, whilst the lock is of simple construction and requires only a simple key to open same, the lock cannot easily be picked since both levers on both sides of the partition must be moved simultaneously.

The arrangement described is also particularly simple to manufacture having regard to the possibility of using plastics mouldings for the container halves, and having regard to the simplicity of the hinge joints and lock mechanisms.

It is of course to be understood that the invention is not intended to be restricted to the details of the above embodiment which is described by way of example only. In particular, whilst the embodiment described is for use in displaying cassettes it is to be understood that the invention may be used in conjunction with other articles.

The container halves may be formed from tinted Perspex or any other suitable material. Conveniently, the container halves may be identical whereby only one mould is required.

What I claim is:

1. A display device for displaying a plurality of articles comprising a lockable compartmentalised container formed from two container parts mounted on a support means:

each container part being in the form of an elongated box structure having: front and back elongated walls each having short top and bottom edges and long side edges; a top wall extending between adjacent said top edges of the front and back walls, a bottom wall extending between adjacent said bottom edges of the front and back walls; a side wall extending between one pair of adjacent side edges of the front and back walls, an article receiving side opening opposite said side wall and between the other pair of adjacent side edges, and at least one intermediate wall extending between the front and back walls and parallel to the top and bottom walls so as to divide the box structure into a plurality of open sided compartments for receiving said articles to be displayed, the width of each said side wall, and of each said side wall opening, being less than the width of each said front wall and back wall whereby said compartments are each of generally flat rectangular form and the front and back walls being formed so as to permit inspection of articles in the compartments through the front and back walls, the two container parts being connected with each other by connection means for movement from an open position with both said other pairs of adjacent side edges spaced apart from each other to enable an article to be received in the side openings thereof to a closed position with both said other pairs of adjacent side edges abutting each other to enable each said part to form a closure for the opening, locking means being provided for locking the container parts in said closed position.

2. A display device according to claim 1 wherein:

said connection means is a pivot means external to said container parts said container parts being rectilinearly aligned in extension of each other when closed and being angularly related to each other when open.

3. A display device according to claim 2 wherein the compartmentalised container is mounted on the support means with the container parts vertical and the container is connected to the support means via pivot means which permits rotation of the container about a vertical axis.

* * * * *